US006025771A

United States Patent [19]

Kobayashi et al.

[11] Patent Number: 6,025,771

[45] Date of Patent: Feb. 15, 2000

[54] PTC THERMISTOR DEVICE

[75] Inventors: Kazumi Kobayashi, Ichikawa; Tsutomu Kotani, Kamagaya; Kazuo Saitoh, Yuri-gun, all of Japan

[73] Assignee: TDK Corporation, Tokyo, Japan

[21] Appl. No.: 09/147,853

[22] PCT Filed: Sep. 22, 1997

[86] PCT No.: PCT/JP97/03364

§ 371 Date: Mar. 22, 1999

§ 102(e) Date: Mar. 22, 1999

[87] PCT Pub. No.: WO98/12716

PCT Pub. Date: Mar. 26, 1998

[30] Foreign Application Priority Data

Sep. 20, 1996 [JP] Japan ..... 8-250211
Apr. 25, 1998 [JP] Japan ..... 9-108455

[51] Int. Cl.[7] ..... H01C 7/10

[52] U.S. Cl. ..... 338/22 R; 338/225 D; 338/20; 338/21

[58] Field of Search ..... 338/22 R, 21, 338/25, 225 D

[56] References Cited

U.S. PATENT DOCUMENTS

| | | | |
|---|---|---|---|
| 4,894,637 | 1/1990 | Yamada et al. | 338/22 R |
| 5,218,336 | 6/1993 | Murakami | 338/328 |
| 5,606,302 | 2/1997 | Ichida | 338/22 R |
| 5,714,924 | 2/1998 | Takeuchi et al. | 338/22 R |
| 5,760,336 | 6/1998 | Wang | 174/52.1 |

FOREIGN PATENT DOCUMENTS

| | | |
|---|---|---|
| 3-99402 | 4/1991 | Japan . |
| 3-104704 | 10/1991 | Japan . |
| 5-73901 | 10/1993 | Japan . |
| 6-7203 | 1/1994 | Japan . |
| 2513634 | 7/1996 | Japan . |
| 9-92506 | 4/1997 | Japan . |

*Primary Examiner*—Michael L. Gellner
*Assistant Examiner*—Richard K. Lee
*Attorney, Agent, or Firm*—Oblon, Spivak, McClelland, Maier & Neustadt, P.C.

[57] ABSTRACT

A positive temperature coefficient (PTC) thermistor device for improving workability during assembly of a PTC thermistor element in a casing while eliminating risk of damaging electrode surfaces with enhanced element position stability. To this end, the casing is provided with an insulating guide section for guiding the PTC thermistor element at or near one end, causing the PTC thermistor element to be elastically held by first and second terminals both at a position on one electrode surface which position is near the other edge of the PTC thermistor element and at a position centrally placed on the remaining electrode surface. The guide section essentially consists of first and second guide sections which oppose each other with the PTC thermistor element being sandwiched between, allowing PTC thermistor element to be held by either one of the first and second guide sections and by the first and second terminals. Further provided are hook sections for being latched by a hand tool or jig at a certain location near a contact section of either one of the terminals.

10 Claims, 12 Drawing Sheets

PTC THERMISTOR DEVICE

BACKGROUND OF THE INVENTION

1. Field of the Invention

The present invention relates to a positive temperature coefficient (hereinafter referred to as PTC) thermistor device which includes a PTC element and more particularly, it relates to support structures for a PTC thermistor element.

2. Discussion of the Background

PTC thermistor devices are used with motor drive circuits or the like in electric refrigerators, for example. A PTC thermistor element which is employed in a PTC thermistor device is one of semiconductor temperature sensor devices, which noticeably increases its resistivity in a non-linear or exponential manner as the temperature increases and which has a positive temperature coefficient as a whole. Typically, such PTC thermistor element is held or housed in its associative vessel such as an enclosure or casing, and is attached to a motor drive circuit, for instance.

PTC thermistor elements are those devices having a function of suppressing flow of current by heat generation. However, where the PTC thermistor element is abnormal in operation, thermorunaway can arise due to flow of overcurrent, causing the element to rapidly increase in temperature, which would lead to element destruction.

Conventionally, even upon occurrence of the element destruction mentioned above, it is not possible to reliably interrupt or cut off the flow of overcurrent, which would result in an increase of the risk of combustion of the casing or the like due to continuous flow of such overcurrent. In view of this, it has been long desired that once the aforesaid element destruction occurs, any possible flow of overcurrent be successfully interrupted or shut down eliminating accidental firing or equivalents thereto, thus increasing reliability.

A conventional PTC thermistor device is shown in FIG. 15. In this figure, reference numeral 1 indicates a PTC thermistor element, 2 indicates electrodes of the PTC thermistor element 1, 3 indicates a support member of the PTC thermistor element 1, 5 indicates a casing, 6 and 7 indicate terminal sections, 8 and 9 indicate spring members as integral with the terminal sections 8 and 9 respectively, 10 indicates a spring contact piece (contact section to be contacted with electrode 2), and 11 indicates a spring contact piece support section.

The prior art illustrated in FIG. 15 is arranged such that the plate-shaped PTC thermistor element 1 having electrodes 2 formed on its both principal surfaces is housed within the insulating casing 5 and is elastically held by spring members 8 and 9 each consisting of an elastic or resilient metal plate, while causing the spring members 8 and 9 to be secured to the terminal sections 6 and 7. Each spring member 8 and 9 includes a spring contact piece support section 11 of a substantially constant width extending in parallel to the electrodes 2 on the principal surface of the PTC thermistor element 1, and spring contact pieces 10 (contact sections) which extend from respective ends of this spring contact piece support section 11 and being bent toward the principal surface electrodes 2 of PTC thermistor element 1 to become into contact with the electrodes 2 and thereafter being bent toward the spring contact piece support section 11 (see Unexamined Japanese Utility-Model Publication No. 3-99402).

Another PTC thermistor device belonging to the prior art is shown in FIG. 16. In this figure, numeral 15 indicates a PTC thermistor element, 16 indicates electrodes of the PTC thermistor element 15, and 17 and 18 indicate terminals. The prior art illustrated in FIG. 16 is arranged such that the PTC thermistor element 15 having electrodes 16 formed on two outer opposite surfaces thereof is elastically supported by a pair of terminals 17 and 18 with elasticity. In this case, the PTC thermistor element 15 is held between both terminals 17 and 18 (PTC thermistor element 15 is supported at three points) while the contact sections 19, 20 and 21 of the terminals 17 and 18 are asymmetrical on both surfaces of PTC thermistor element 15 (see Unexamined Japanese Utility-Model Publication No. 3-99402).

Yet another PTC thermistor device belonging to the prior art is shown in FIG. 17, and FIG. 18 is a cross-sectional view taken along lines 18—18 of FIG. 17. In these figures, numeral indicates a PTC thermistor element, 26 indicates electrodes of PTC thermistor element 25, 28 indicates a casing, 29 and 30 indicate spring members, 31 and 32 indicate terminals integral with spring members 29 and 30 respectively.

The mounting/assembly process of the PTC thermistor element into the PTC thermistor device illustrated in FIGS. 17 and 18 is shown in FIGS. 19 and 20, and FIG. 21 is a flow chart wherein S1 to S6 designate the respective steps of this process. In FIGS. 19 and 20, 34 indicates a guide film.

An explanation will now be given of the PTC thermistor element mounting/assembly process of the prior art shown in FIGS. 17 and 18.

After the terminals 31 and 32 with spring members 29 and 30 are attached to the casing 28, the PTC thermistor element 25 is then inserted between the spring members 29 and 30, allowing PTC thermistor element 25 to be elastically supported by the spring members 29 and 30.

Incidentally, since the electrodes 26 (e.g. silver electrodes) are provided on both sides of the PTC thermistor element 25, when the PTC thermistor element 25 is simply inserted directly between the spring members 29 and 30, the electrodes 26 could come into contact with the spring members 29 and 30 during insertion, which would result in rubbing off and scars. To avoid this, the PTC thermistor element 25 is inserted into the casing 28 by the following assembly process while referring to FIGS. 19 to 21.

First of all, pre-manufactured components are prepared including the casing 28, the terminals 31 and 32 with the spring members 29 and 30, and the PTC thermistor element 25 (step S1 in FIG. 21); then, assembling thereof is started. Terminals 31 and 32 are mounted within the casing 28 (step S2 in FIG. 21); thereafter, two guide films 34 are loaded into the casing 28 (step S3 in FIG. 21). In this case, the two guide films 34 are inserted and set between the spring members 29 and 30.

Next, the PTC thermistor element 25 is inserted between the two guide films 34 in a way shown in FIG. 19 (see also step S4 in FIG. 21). In other words, the PTC thermistor element 25 is pushed thereinto from its upper side. Thereafter, as shown in FIG. 20, while causing the PTC thermistor element 25 to be kept compressed in a direction designated by the arrow shown (downward), the guide films 34 are pulled out in directions indicated by the arrows shown therein (upward) for release to the outside (step S5 in FIG. 21). In this way, the spring members 29 and 30 are in contact with the electrodes 26 of the PTC thermistor element 25, completing the assembly process of PTC thermistor element 25 (step S6 in FIG. 21).

However, the prescribed prior art devices described above encounter the folowing problems.

Where the PTC thermistor element is abnormal in operation, thermorunaway can arise due to flow of overcurrent, causing the element to rapidly increase in temperature, which would lead to element destruction. In such case, when resultant fragments of the PTC thermistor element have dropped down onto the lower part of the casing, electrical circuity will be interrupted. However, the fragments can sometimes be trapped between terminals and under this condition, even where the electrical circuitry per se is shut off, some fragments staying between terminals can behave badly to inhibit intended electrical interruption of the circuitry. If this is the case, the overcurrent might continue flowing, thereby raising the temperature abnormally, which could in the end result in combustion of the casing or the like.

Especially, the PTC thermistor device belonging to the prior art as shown in FIG. 15 is designed such that the PTC thermistor element is supported by multiple contact sections provided at the terminals. Accordingly, after the PTC thermistor element is cracked, its fragments hardly fall down onto the lower part of the casing. This design could sometimes cause burning of the casing or the like as stated above.

With the PTC thermistor device belonging to the prior art as shown in FIG. 16, the PTC thermistor element is easily destructible due to the three-point support of the PTC thermistor element. However, in view of the fact that all the parts supporting the PTC thermistor element are conductive terminals, it is rather difficult upon occurrence of element destruction to interrupt the overcurrent flow unless the destroyed element fragments perfectly fall down onto the lower part of the casing. In other words, if a few fragments are left on the lower part of the casing, the possibility that the flow of overcurrent through the electrodes of such destructed PTC thermistor element and/or terminals continues remains high, which would sometimes result in firing accidents as discussed previously.

Another problem encountered in the PTC thermistor devices of the prior art is where the PTC thermistor element is mounted for assembly into the casing wherein guide films are employed, as shown in FIGS. 19 and 20 for example. Such PTC thermistor element assembly process suffers from the following problems.

(a) Loading and unloading of the guide films require time consuming and troublesome works lowering workability.

(b) Positional deviations of the PTC thermistor element will possibly occur when unloading the guide films, which in turn makes it difficult to achieve accurate position determination or alignment of the PTC thermistor element.

(c) During insertion (press fitting) of the PTC thermistor element between the guide films, these guide films must rub the electrode of the PTC thermistor element causing the electrodes to become scarred on the surfaces thereof.

(d) Use of the guide films increases costs.

SUMMARY OF THE INVENTION

It is an object of the present invention to provide a PTC thermistor device which can avoid the problems faced with the aforesaid prior art devices.

It is a further object of the present invention to provide a PTC thermistor device which interrupts any possible overcurrent by accelerating spatial separation of fragments when a PTC thermistor element is destroyed due to thermal runaway.

It is a still further object of the present invention to provide a PTC thermistor device which can improve workability during mounting of the PTC thermistor element into an associated casing.

It is a still further object of the invention to provide a PTC thermistor device which can eliminate occurrence of scars on electrode surfaces moreover enhancing stability of element position alignment.

In order to achieve these objects, the present invention discloses two aspects of a PTC thermistor device. A PTC thermistor device according to the first aspect of the present invention comprises a PTC thermistor element, an insulating casing, a first terminal and a second terminal. The PTC thermistor element is provided with electrodes on both its surfaces. The casing is provided with an insulating guide section for guiding certain portions at or near one end of the PTC thermistor element. The first terminal provided with a contact section having conductivity and elasticity, and the second terminal provided with a contact section having conductivity but no elasticity are attached to the casing and elastically support the electrodes of the PTC thermistor element at selected positions, one of which is at or near the other end of the PTC thermistor element on one electrode and the other of which is at or near the center of the PTC thermistor element on the remaining electrode.

In the PTC thermistor device according to the first aspect of the present invention, the casing is provided with first and second insulating guide sections for guiding certain portions at or near one end of the PTC thermistor element while at the same time causing the first and second terminals to elastically support one electrode surface at or near the other end of the PTC thermistor element and the remaining electrode at or near the center of the PTC thermistor element.

With such an arrangement, where the PTC thermistor element accidentally experiences thermorunaway, the element is rendered easily destructible and, simultaneously, all fragments of the destroyed element are forced to successfully drop down onto the lower part of the casing with each fragment being spatially dispersed or far apart from the others and no fragment is trapped between terminals. Consequently, continuous flow of overcurrent after element destruction does not occur. Furthermore, the PTC thermistor element is of the prescribed three-point support structure with one point thereof being comprised of the insulating guide section, therefore, upon occurrence of element destruction, the risk of continuous flow of overcurrent may be minimized causing reliability to increase in this respect also.

In the PTC thermistor device according to the first aspect of the present invention, the guide section is desirably provided with first and second guide sections which are configured to oppose each other, with the PTC thermistor element being laid between them, supporting the PTC thermistor element by either one of the first and second guide sections and by the first and second terminals. This structure may render the terminal positions freely changeable as necessary.

Another desirable structure of the PTC thermistor device according to the first aspect of the present invention is that the first and second terminals have contact sections for forming contacts with the electrodes of the PTC thermistor element while providing at or near the contact sections of either terminal, a hook section for being latched by a hand tool or jig.

With such an arrangement, the required task to be executed after placing the PTC thermistor element between the terminals is merely to unload the jig used. Accordingly, any positional deviations of the PTC thermistor element will no longer take place enabling accomplishment of easy and stable assembling of the PTC thermistor element. Simultaneously, it becomes possible to prevent the PTC thermistor element from becoming scarred on the electrodes thereof.

A PTC thermistor device according to a second aspect of the present invention includes a PTC thermistor element, an insulating casing and first and second terminals. The PTC thermistor element is provided with electrodes on both its surfaces. The casing is provided with a support member to support the PTC thermistor element. The first and second terminals are attached to the casing and hold the PTC thermistor element. The first terminal is provided with a contact section having conductivity and elasticity, and the second terminal is provided with a contact section having conductivity but no elasticity. Either one of the surfaces of the PTC thermistor element is supported by the support member, the contact section of the second terminal is into contact with part of the PTC electrode which is spaced apart from the support member on the same surface, and the contact section of the first terminal is in contact with the PTC electrode on the other surface of the PTC thermistor element.

With such an arrangement, where the PTC thermistor element accidentally experiences thermorunaway, the element is rendered easily destructible and, simultaneously, all fragments of the destroyed element are forced to successfully drop down onto the lower part of the casing with each fragment being spatially dispersed or far apart from the others and no fragment is trapped between terminals. Consequently, continuous flow of overcurrent after element destruction does not occur. Further, the PTC thermistor element is of the prescribed three-point support structure with one point thereof having elasticity. Therefore, upon occurrence of element destruction, the risk of continuous flow of overcurrent may be minimized causing reliability to increase in this respect also.

In the PTC thermistor device according to the second aspect of the present invention, the contact section of the first terminal may be forced to become in contact with the electrode of the PTC thermistor element at a selected position which is near the support member side by a distance equivalent to approximately two third the interval between the support member and the contact section of the second terminal.

With such an arrangement, the distance between the first terminal and second terminal increases, eliminating almost perfectly the risk of short-circuiting between both electrodes upon occurrence of destruction of the PTC thermistor element.

In the PTC thermistor device according to the second aspect of the present invention, the support member may be made of stainless steel or any equivalent alloys thereto. Constituting the support member from stainless steel may increase heat resistivity as compared to those support members made of resin. This may serve to exclude any possibilities of causing the support member to become scarred or start burning due to heat evolution at the PTC thermistor element while enhancing durability and eliminating burning, smoking or the like at the casing.

In the PTC thermistor device according to the second aspect of the present invention, the width of a conductive section between each of the contact sections of the first terminal and second terminals in contact with the electrodes of the PTC thermistor element and its associative external terminal section, is so designed as to be less than widths of any remaining conductive sections of the terminals thereby increasing heat release resistance.

With such a scheme, any heat generated at the PTC thermistor element hardly escapes to the outside. Accordingly, it becomes possible to force heat to reside within this PTC thermistor element thus enabling efficient suppression of overcurrent by modifying the resistance value of such PTC thermistor element. This may reduce power dissipation of the PTC thermistor device.

BRIEF DESCRIPTION OF THE DRAWINGS

These and other objects, features and advantages of the invention will be apparent from the following more particular description of preferred embodiments of the invention, as illustrated in the accompanying drawings, wherein.

DETAILED DESCRIPTION OF THE PREFERRED EMBODIMENTS

Figure 1:
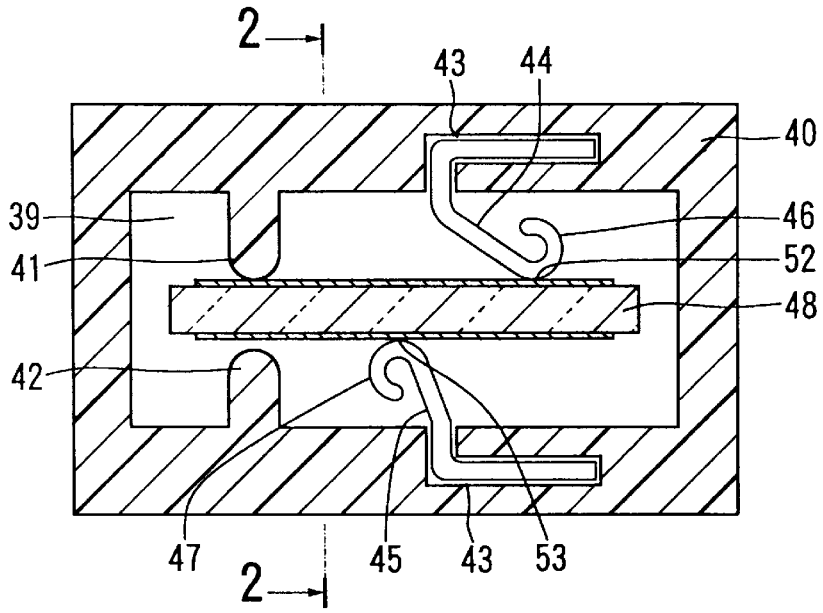
FIG. 1 is a plan view of an embodiment of a PTC thermistor device of the present invention.
Figure 2:
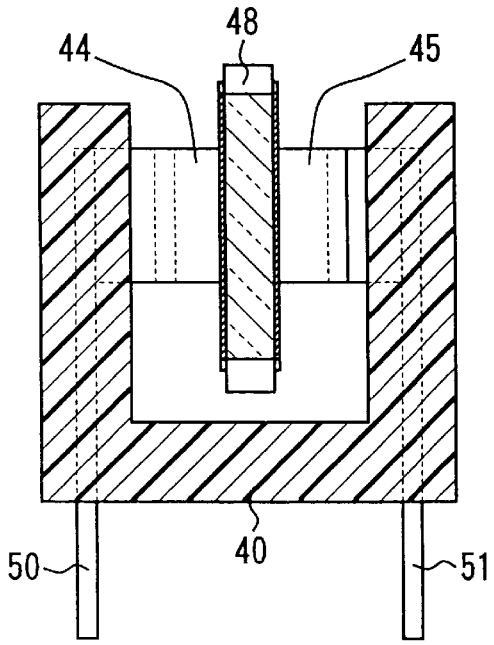
FIG. 2 is a cross-sectional view taken along lines 2—2 in FIG. 1.

Referring to FIGS. 1 and 2, the PTC thermistor device according to the present invention comprises a casing 40, a first terminal 44, a second terminal 45 and a PTC thermistor element 48. The casing 40 is made of an insulating resin and has a hollow section 39 as formed therein for insertion of the PTC thermistor element 48. Also formed in the casing 40 are a first fi guide section 41 and second guide section 42 which are made of an insulating resin and project into the interior of hollow section 39.

The first guide section 41 and second guide section 42 are disposed at selected positions which enable guidance for position alignment of a portion at or near either one of the opposite ends of PTC thermistor element 48 when this PTC thermistor element 48 is inserted thereinto and which oppose each other with PTC thermistor element 48 being laid between them. The distance between a distal end of first guide section 41 and that of second guide section 42 is designed to be slightly greater than the thickness of PTC thermistor element 48 per se.

With the arrangement described above, the PTC thermistor device is obtained, in which the casing 40 is provided with the insulating guide sections 41 and 42 for guiding certain portions at or near one end of the PTC thermistor element 48, while causing the first and second terminals 44 and 45 to elastically support the electrodes of PTC thermistor element 48 at selected positions, one of which is at or near the other end of PTC thermistor element 48 on one electrode and the other of which is at or near the center of PTC thermistor element 48 on the remaining electrode.

In the PTC thermistor device according to the present invention, the casing 40 is provided with first and second insulating guide sections 41 and 42 for guiding certain portions at or near one end of the PTC thermistor element 48 while at the same time causing the first and second terminals 44 and 45 to elastically support one electrode surface at or near the other end of PTC thermistor element 48 and the remaining electrode at or near the center of the PTC thermistor element 48.

With such an arrangement, where the PTC thermistor element 48 accidentally experiences thermorunaway, the element is rendered easily destructible and simultaneously, all fragments of the destroyed element are forced to successfully drop down onto the lower part of the casing 40 with each fragment being spatially dispersed or far apart from the others and no fragment is trapped between the first terminal 44 and second terminal 45. Consequently, continuous flow of overcurrent after element destruction does not occur. Further, the PTC thermistor element 48 is of the prescribed three-point support structure with one point thereof being comprised of the insulating guide section 41 or 42. Therefore, upon occurrence of element destruction, the risk of continuous flow of overcurrent is minimized causing reliability to increase in this respect also.

The casing 40 is also provided with a plurality of terminal insertion grooves 43 which are arranged to allow the first terminal 44 and second terminal 45 to be inserted (pushed under certain pressure) thereinto. In this case, the first terminal 44 and second terminal 45 are integral with external terminal sections 50 and 51 respectively, to facilitate the first and second terminals 44 and 45 including these external terminal sections 50 and 51 to be attached by insertion (press fitting) into the terminal insertion grooves 43.

Figure 4:
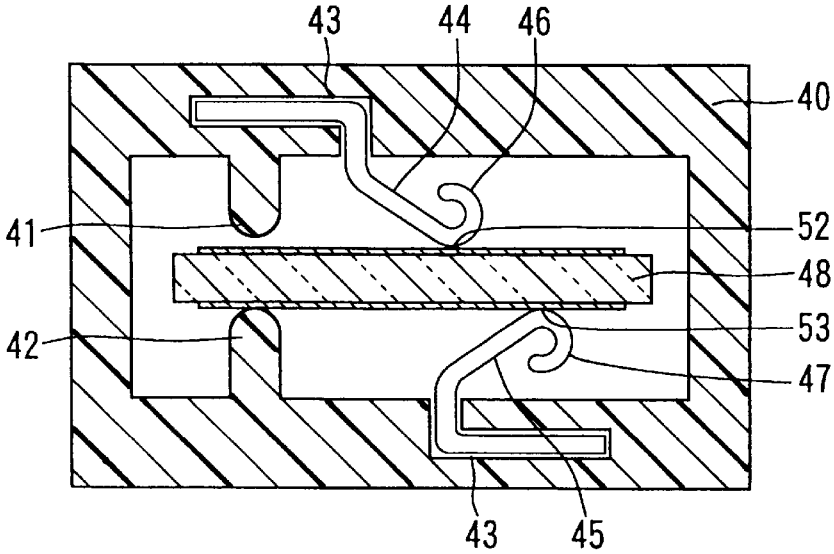
FIG. 4 is a view of another embodiment of a PTC thermistor device of the present invention.

The attachment positions of the first terminal 44 and second terminal 45 are modifiable between the positions shown in FIGS. 1 and 2 and those shown in FIG. 4. Whereby, it becomes possible to modify or change the demounting positions of external terminal sections 50 and 51. When the PTC thermistor element 48 is inserted into casing 40, the first and second guide sections 41 and 42 function to guide intended portions at or near one end of PTC thermistor element 48 irrespective of the actual terminal positions.

At the terminal positions shown in FIG. 1, the contact section 52 of first terminal 44 pushes one electrode surface of the PTC thermistor element 48 at a position near the other end thereof (near the end opposite to first guide section 41) whereas the contact section 53 of second terminal 45 pushes the remaining electrode surface at or near the center of PTC thermistor element 48.

In this way, the two terminals with elasticity resiliently hold therebetween the PTC thermistor element 48 on the electrode surfaces thereof. In this case, the PTC thermistor element 48 is supported at three points (i.e. the first guide section 41, the contact section 52 of first terminal 44, and the contact section 53 of second terminal 45). In this case, a slight gap is defined between the electrode surfaces of the PTC thermistor element 48 and the second guide section 42 so that the both are not in contact with each other.

On the other hand, at the terminal positions shown in FIG. 4, the contact section 52 of first terminal 44 pushes one electrode surface of the PTC thermistor element 48 at or near the center thereof, whereas the contact section 53 of the second terminal 45 pushes the remaining electrode surface at or near the other end of PTC thermistor element 48 (near the end opposite to second guide section 42).

In this way, the two terminals with elasticity act to resiliently hold therebetween the PTC thermistor element 48 on the electrode surfaces thereof in a way such that the PTC thermistor element 48 is supported at three points, namely, the second guide section 42, the contact section 52 of first terminal 44, and the contact section 53 of second terminal 45. In this case, a slight gap remains between the electrode surfaces of PTC thermistor element 48 and the first guide section 41 so that both are never in contact with each other.

As discussed previously, in order to render the terminal attachment positions freely changeable, the casing 40 has terminal insertion grooves as formed at at least three positions corresponding to the terminal attachment positions of respective terminals. More specifically, during manufacture of the casing 40, terminal insertion grooves 43 are respectively formed at the attachment positions of the first and second terminals 44 and 45 shown in FIG. 1 and also at the attachment positions of the first and second terminals 44 and 45 shown in FIG. 4. Selecting an appropriate one from among these groove position pairs in conformity with the terminal positions, when insertion of the terminals makes it possible to freely change the terminal positions.

Incidentally, the first terminal 44 and the second terminal 45 are respectively inserted and held in separate terminal insertion grooves 43. In this case, the first terminal 44 and the second terminal 45 are comprised of those components and each formed by bending a plate-like body (conductive metal plate) with conductivity and elasticity. Contact sections 52 and 53 are formed at the distal ends of the first terminal 44 and the second terminal 45 while forming at or near the contact sections 52 and 53 hook sections 46 and 47 for being latched by a jig (not shown).

Where the PTC thermistor element 48 is mounted in the casing 40, the first and second terminals 44 and 45 are first inserted into the terminal insertion grooves 43. Then, use of a hand tool or jig is made to open either one of such terminals. When this is done, the distal end of the jig at the hook section (46 or 47) provided at part of the terminal is latched to pull it, causing the terminal to open outward.

By way of example, the jig at either the hook section 46 of first terminal 44 or hook 47 of second terminal 45 is latched, letting the terminal contact section open outward. Then, the PTC thermistor element 48 is set at a predefined position between such opened terminals. Next, the jig is taken out of the hook section allowing the terminal to return at its initial position. In this way, assembly or mounting of PTC thermistor element 48 is completed.

With such an arrangement, the required task to be executed after placing of the PTC thermistor element between the terminals is merely to unload the jig used. Accordingly, any positional deviations of the PTC thermistor element will no longer take place enabling accomplishment of easy and stable assembling of the PTC thermistor element. Simultaneously, it becomes possible to prevent the PTC thermistor element 48 from becoming scarred on the electrodes thereof.

Figure 3:
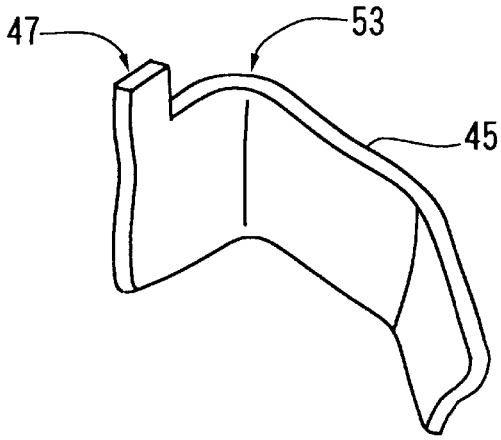
FIG. 3 is a perspective view of a terminal other than that shown in FIGS. 1 and 2, which may be employed in the PTC thermistor device shown in FIGS. 1 and 2.

The shape of the hook sections 46 may be a spiral form as shown in FIG. 1, or alternatively, a projection shape shown as a modification in FIG. 3. In either case, any shapes may be employed as far as these offer capability of enlarging the distance between the terminals by latching the jig at such hook section (s).

Figure 5:
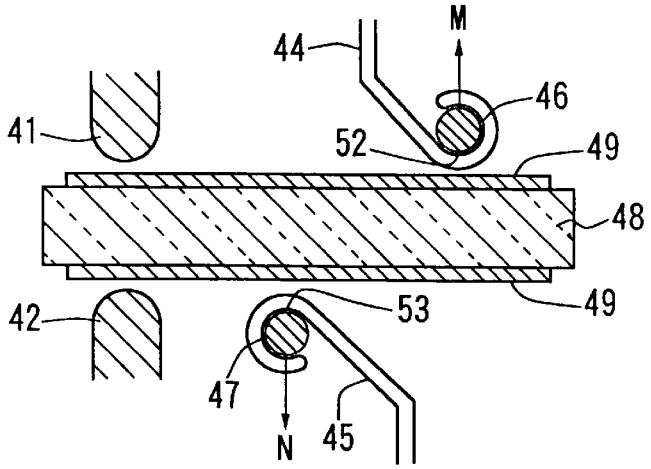
FIG. 5 is a diagram explaining the mounting/assembly process of the PTC thermistor shown in FIGS. 1 to 4.
Figure 6:
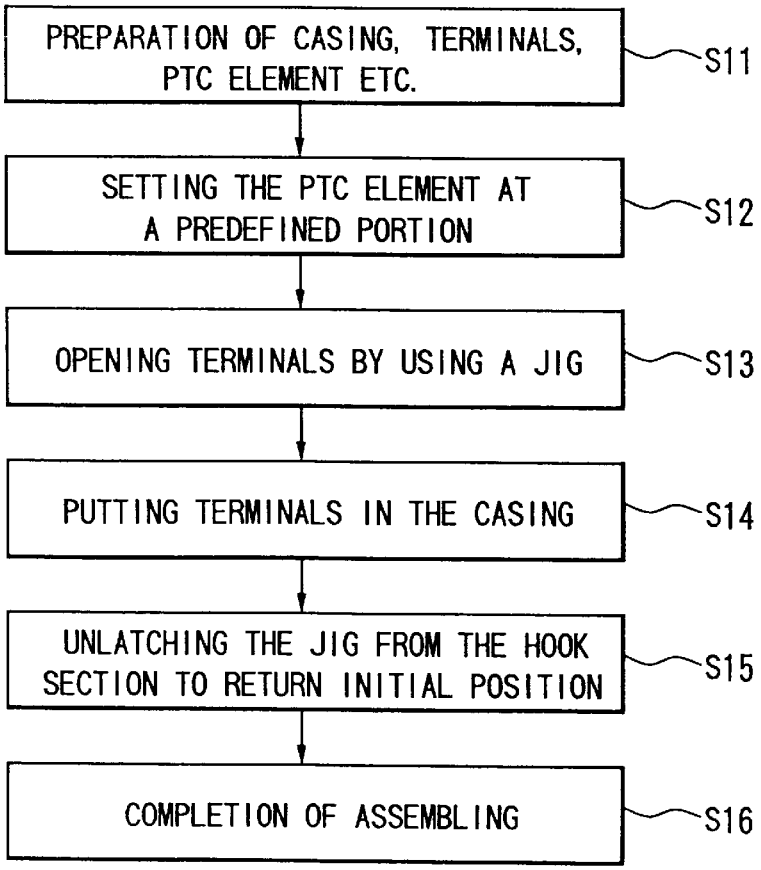
FIG. 6 is a flowchart explaining the mounting/assembly process of the PTC thermistor shown in FIGS. 1 to 4.

FIG. 5 is a diagram explaining the mounting/assembly process of the PTC thermistor shown in FIGS. 1 to 4, and FIG. 6 is a flowchart explaining the mounting/assembly process of the PTC thermistor shown in FIGS. 1 to 4. Note that S11 to S16 designate respective steps in the assembly process.

First, premanufactured components including the casing 40 are prepared, first and second terminals 44 and 45, and PTC thermistor element 48 (step S11); then, assembly thereof is started. First and second terminals 44 and 45 are put in the casing 40 for assembly (step S12). Next, use of a jig is made to let either one terminal spread outward or "open".

In this case, as shown in FIG. 5, while the casing 40 is rendered stationary, the distal end of the jig at the hook section (46 or 47) provided near the contact section of a corresponding terminal is latched to pull (by hand or using assembly machines) this jig in a direction M as designated by an arrow shown therein, or a direction N thus letting the terminal open. Note here that both terminals may be opened in an outward direction at a time.

By way of example, the jig either at the contact section 52 of the first terminal 44 or at the contact section 53 of second terminal 45 is latched, causing the terminal to open outwardly (step S13). Then, the PTC thermistor element 48 is set at a predefined position between such expanded terminals (step S14); thereafter, the jig is unlatched from the hook section causing the terminal to return to its initial position (step S15). In this way, assembling of the PTC thermistor element 48 is completed (step S16).

Figure 7:
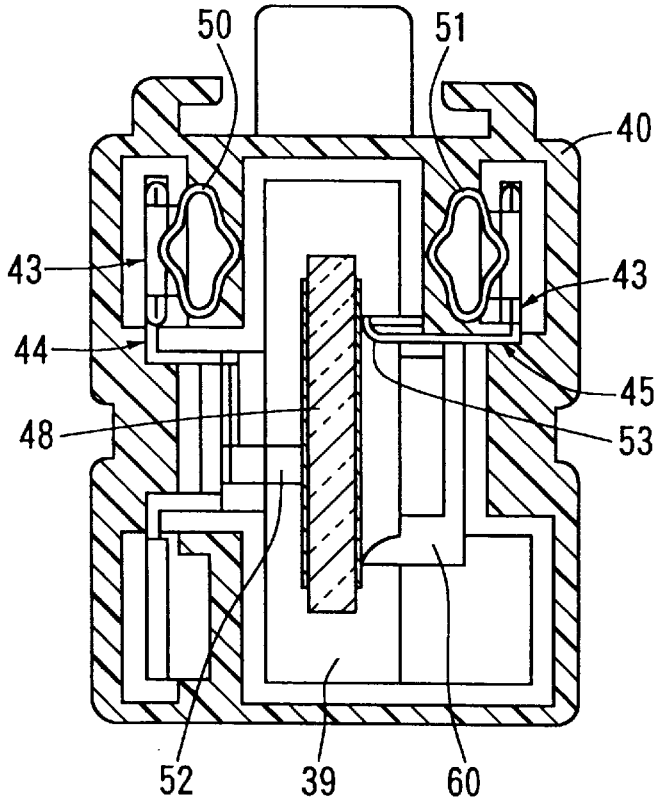
FIG. 7 is a plan view of yet another embodiment of a PTC thermistor device of the present invention.
Figure 8:
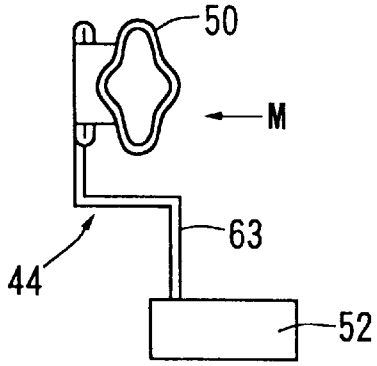
FIG. 8 is a plan view of a first teminal which is employed in the PTC thermistor device illustrated in FIG. 7.
Figure 9:
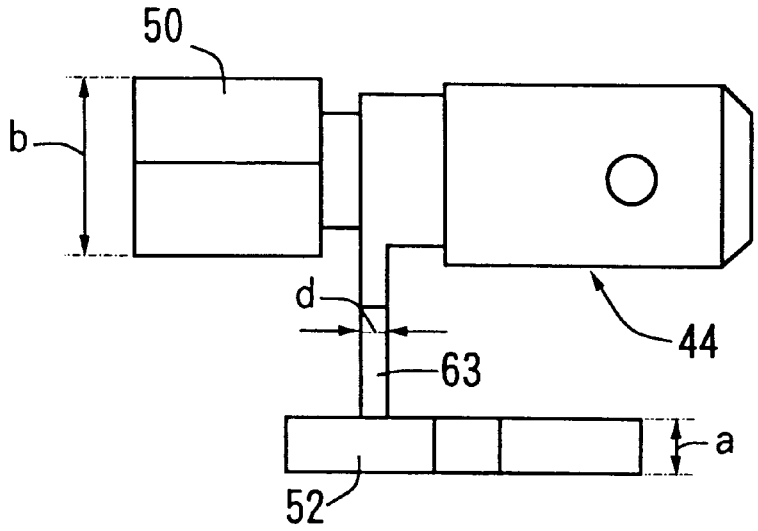
FIG. 9 is a side view of the first terminal as looked at from a direction M of FIG. 8.
Figure 10:
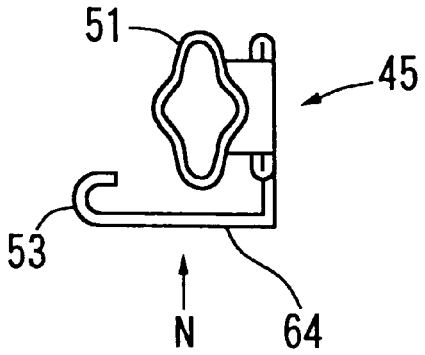
FIG. 10 is a plan view of a second teminal which is employed in the PTC thermistor device illustrated in FIG. 7.
Figure 11:
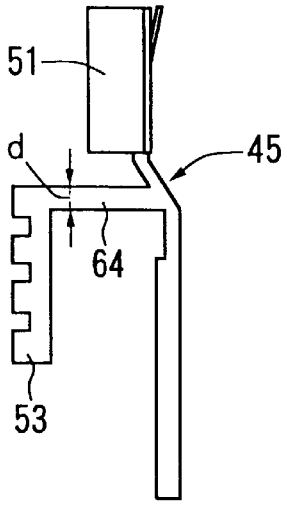
FIG. 11 is a side view of the second terminal as looked at from a direction M of FIG. 8.

FIG. 7 is a view of yet another embodiment of a PTC thermistor device of the present invention, FIG. 8 is a front view of a first teminal which is employed in the PTC thermistor device illustrated in FIG. 7, FIG. 9 is a side view of the first terminal as looked at from a direction M of FIG. 8, FIG. 10 is a front view of a second teminal which is employed in the PTC thermistor device illustrated in FIG. 7, and FIG. 11 is a side view of the second terminal as looked at from a direction M of FIG. 8.

The casing 40 is made of chosen insulating resin (e.g. polyester resin) and has a hollow section 39 which is formed in its interior for permitting insertion of the PTC thermistor element 48 thereinto. The casing 40 is also provided with the insulating support member 60 which is made of the same insulating resin (e.g. polyester resin) and has a projected portion for contact with PTC thermistor element 48, which portion extends inside the hollow section 39.

The PTC thermistor device illustrated in FIG. 7 includes an insulating casing 40, first and second terminals 44 and 45 attached to the casing 40, and a PTC thermistor element 48 having electrodes on its both surfaces, thus having a PTC thermistor element support structure for supporting the PTC thermistor element 48 by the first and second terminals 44 and 45 at the opposite surfaces thereof. In this case, the casing 40 is provided with an insulating support member 60 which supports certain parts at or near the end of either one surface of PTC thermistor element 48. In addition, the first terminal 44 is provided with a contact section 52 having conductivity and elasticity whereas the second terminal 45 is provided with a contact section 53 having conductivity but no elasticity.

One surface of the PTC thermistor element 48 is supported by the insulating support member 60 at a location near the end thereof while causing the contact section 53 of second terminal 45 to come into contact with certain PTC electrode portions on the same surface which portion is spaced apart from the support member 60 and also causing the contact section 52 of first terminal 44 to become in contact with a PTC thermistor element electrode on the opposite surface of the PTC thermistor element. In this case, the contact section 52 of the first terminal 44 is designed to become in contact with the PTC thermistor element electrode at a specifically selected position which is near the support member side and is approximately two third the distance between the support member 60 and the contact section 53 of the second terminal 45.

As has been described above, the casing 40 illustrated in FIG. 7 is provided with the support member 60 for support of the PTC thermistor element 48, the first terminal 44 is provided with a contact section 52 having conductivity and elasticity, the second terminal 45 is provided with a contact section 53 having conductivity but no elasticity, either one of the surfaces of the PTC thermistor element 48 is supported by the support member 60, the contact section 53 of the second terminal 45 is brought into contact with part of the PTC electrode which is spaced apart from the support member 60 on the same surface, and the contact section 52 of the first terminal 44 is forced to become in contact with the PTC electrode on the remaining surface of the PTC thermistor element 48.

With such an arrangement, in cases where the PTC thermistor element 48 accidentally experiences thermorunaway, the element remains easy to destruct and, simultaneously, all fragments of the destroyed element are forced to successfully drop down onto the lower part of the casing 40 with each fragment being spatially dispersed or far apart from the others and no fragments are trapped between the first terminal 44 and second terminal 45. Consequently, continuous flow of overcurrent after element destruction does not occur. Further, the PTC thermistor element 48 is of the prescribed three-point support structure with only a single point thereof having an elastic terminal contact structure. Therefore, upon occurrence of element destruction, short-circuit between terminals does no longer occur while minimizing the risk of continuous flow of overcurrent thereby letting reliability increase in this respect also.

Furthermore, with the PTC thermistor device illustrated in FIG. 7, the contact section 52 of the first terminal 44 is forced to become in contact with the electrode of the PTC thermistor element 48 at a selected position which is near the support member 60 side by a distance equivalent to approximately two third the interval between the support member 60 and contact section 53 of the second terminal 45. Hence, the distance between the first terminal 44 and second terminal 45 increases eliminating almost perfectly the risk of short-circuiting between the both electrodes upon occurrence of destruction of the PTC thermistor element 48.

The support member 60 may be made of stainless steel or any equivalent alloys thereto. Constituting the support member 60 from stainless steel may increase heat resistivity as compared to those support members made of resin materials. This may serve to exclude any possibilities of causing the support member 60 to become scarred or begin burning due to heat evolution at the PTC thermistor element 48 while enhancing durability and eliminating burning, smoking or the like at the casing.

The width of a conductive section 63 and 64 between each of the contact sections 52 and 53 of the first terminal 44 and second terminal 45 in contact with the electrodes of the PTC thermistor element 48 and its associated external terminal section 50 and 51 is designed to be less than widths of any remaining conductive sections of the terminals thereby increasing heat release resistivity. With such a scheme, any heat generated at the PTC thermistor element 48 hardly escapes to the outside; accordingly, it becomes possible to force heat to reside within this PTC thermistor element 48 thus enabling efficient suppression of overcurrent by modifying the resistance value of such PTC thermistor element 48. This may reduce power dissipation of the PTC thermistor device.

The casing 40 is further provided with a plurality of terminal insertion grooves 43 for allowing the first terminal 44 and second terminal 45 to be inserted into these terminal insertion grooves 43. In this case, the first terminal 44 has its external terminal section 50 and contact section 52 which are integral with each other, with the conductive section 63 coupled therebetween. Similarly, the second terminal 45 has external terminal section 51 and contact section 53 integrally coupled together by conductive section 64. These first and second terminals 44 and 45 are to be inserted for attachment into the terminal insertion grooves 43.

Incidentally, while the first terminal 44 and second terminal 45 are inserted for attachment into separate terminal insertion grooves 43 respectively, the first terminal 44 in this case is constituted by machining a plate-shaped body made of stainless steel (for example, SUS304) with conductivity and elasticity whereas the second terminal 45 is constituted by machining a plate-shaped body made of stainless steel (for example, SUS304) with conductivity but without elasticity at the contact section 53. Note that stainless steel is lower in thermal conductivity than copper and aluminum, thus reducing heat release or radiation.

As discussed above, the first terminal 44 and the second terminal 45 are respectively provided with the conductive sections 63 and 64 while causing the contact sections 52 and 53 for contact with the electrodes of PTC thermistor element 48 to be integrally formed at selected ends of conductive section 63 and 64 and also causing the external terminal sections 50 and 51 to be integrally formed at the opposite ends thereof. Also, the width d of the conductive sections 63 and 64 between the respective contact sections 52 and 53 of the first and second terminals 44 and 45 and the external terminal sections 50 and 51 is narrower than widths of any remaining conductive parts of respective terminals thus increasing heat release resistivity.

In this case, the one example shown in FIGS. 8 to 11 is such that the width d of the conductive sections 63 and 64 is set at d=1 mm. Note that the widths of the remaining conductive parts are as follows: the width b of external terminal section 50 is b=6.2 mm; the width a of external terminal section 52 is a=1.8 mm, by way of example.

Figure 12:
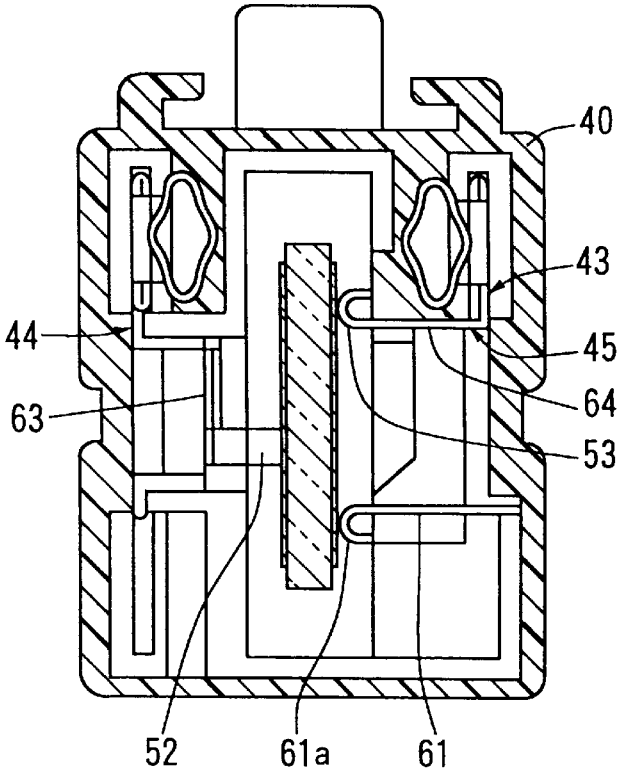
FIG. 12 is a plan view of yet another embodiment of a PTC thermistor device of the present invention.
Figure 13:
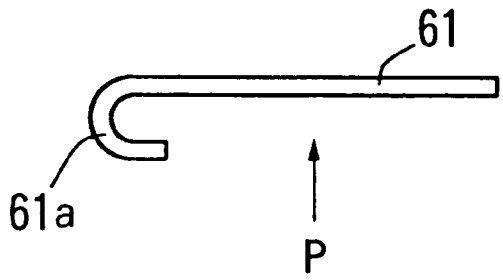
FIG. 13 is a plan view of a support member which is employed in the PTC thermistor device illustrated in FIG. 12.
Figure 14:
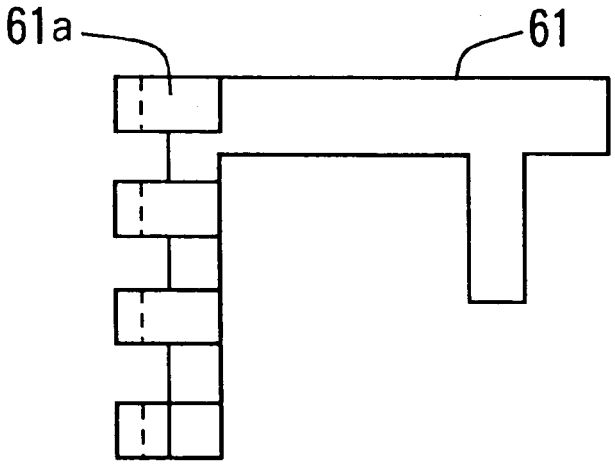
FIG. 14 is a front view of the support member as looked at from a direction P of FIG. 13.
Figure 15:
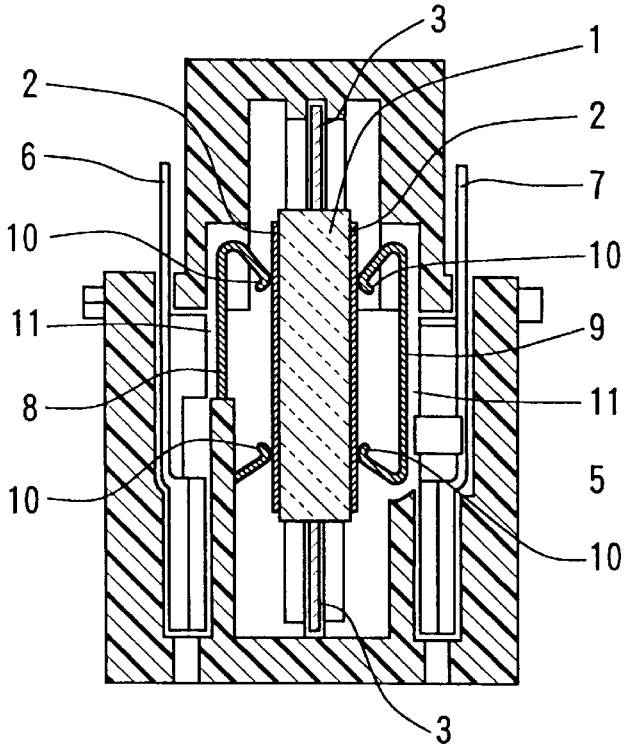
FIG. 15 Prior Art
FIG. 15 is a cross-sectional view of a PTC thermistor device belonging to the prior art.
Figure 16:
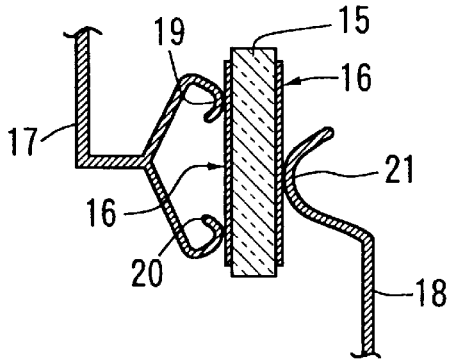
FIG. 16 Prior Art
FIG. 16 is a cross-sectional view of another PTC thermistor device belonging to the prior art.
Figure 17:
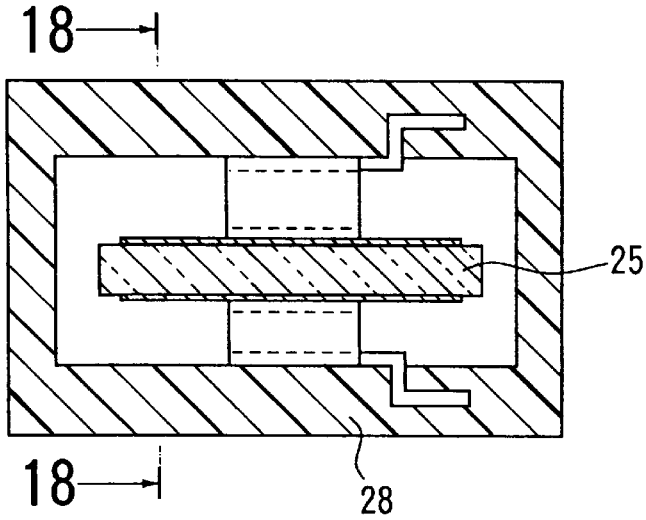
FIG. 17 Prior Art
FIG. 17 is a plan view of yet another PTC thermistor device belonging to the prior art.
Figure 18:
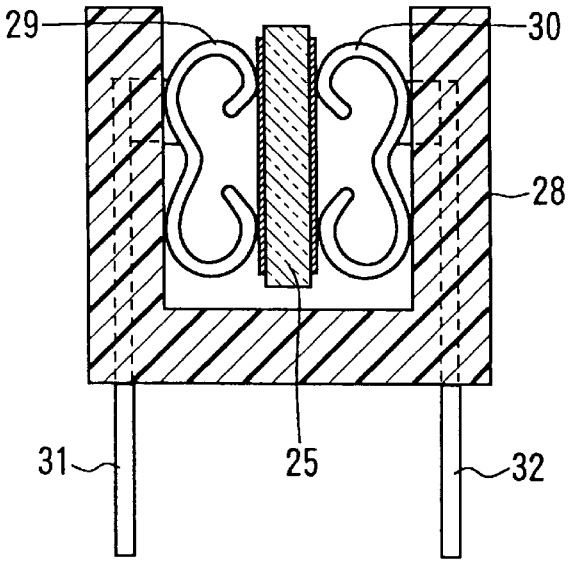
FIG. 18 Prior Art
FIG. 18 is a cross-sectional view taken along lines 18—18 in FIG. 17.
Figure 19:
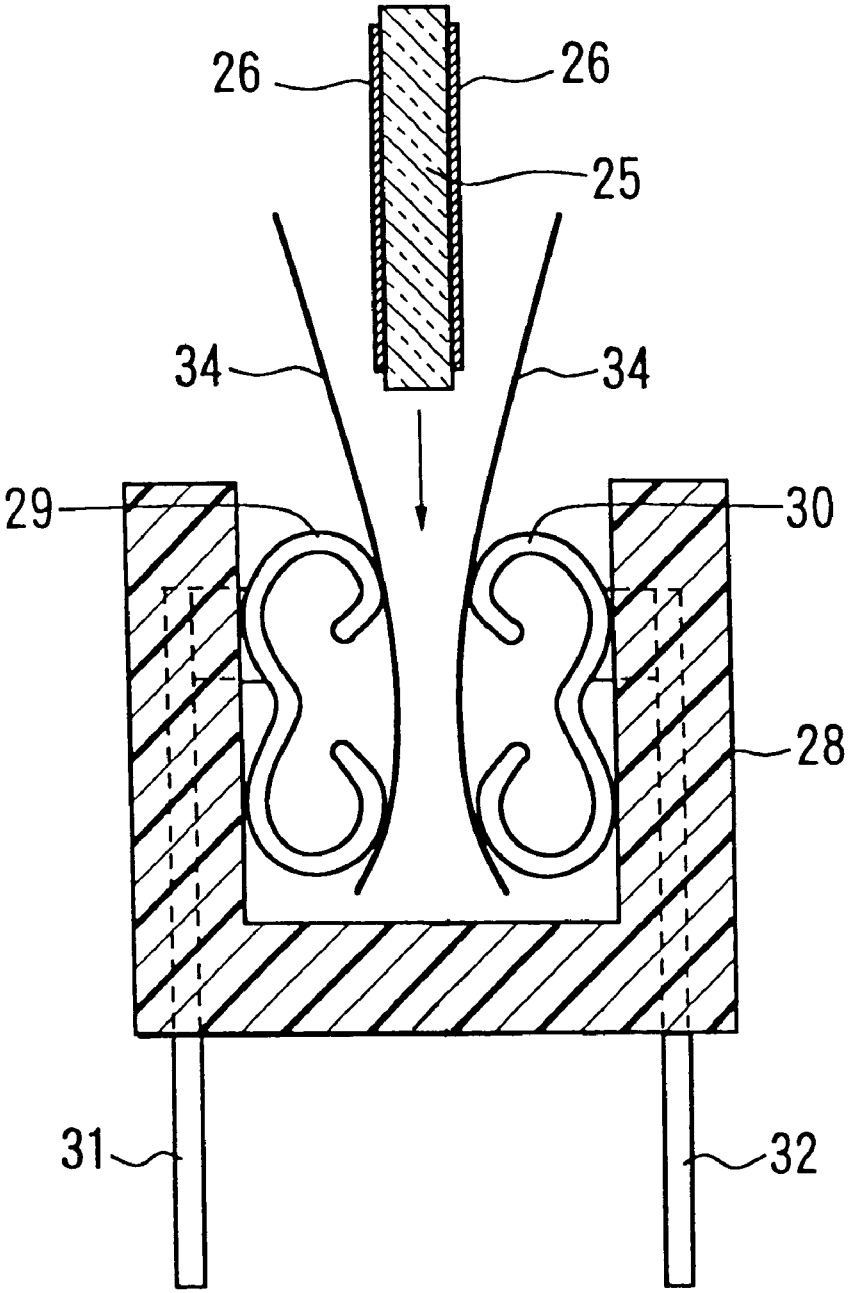
FIG. 19 Prior Art
FIG. 19 is a diagram explaining the mounting/assembly process of the PTC thermistor shown in FIGS. 17 and 18.
Figure 20:
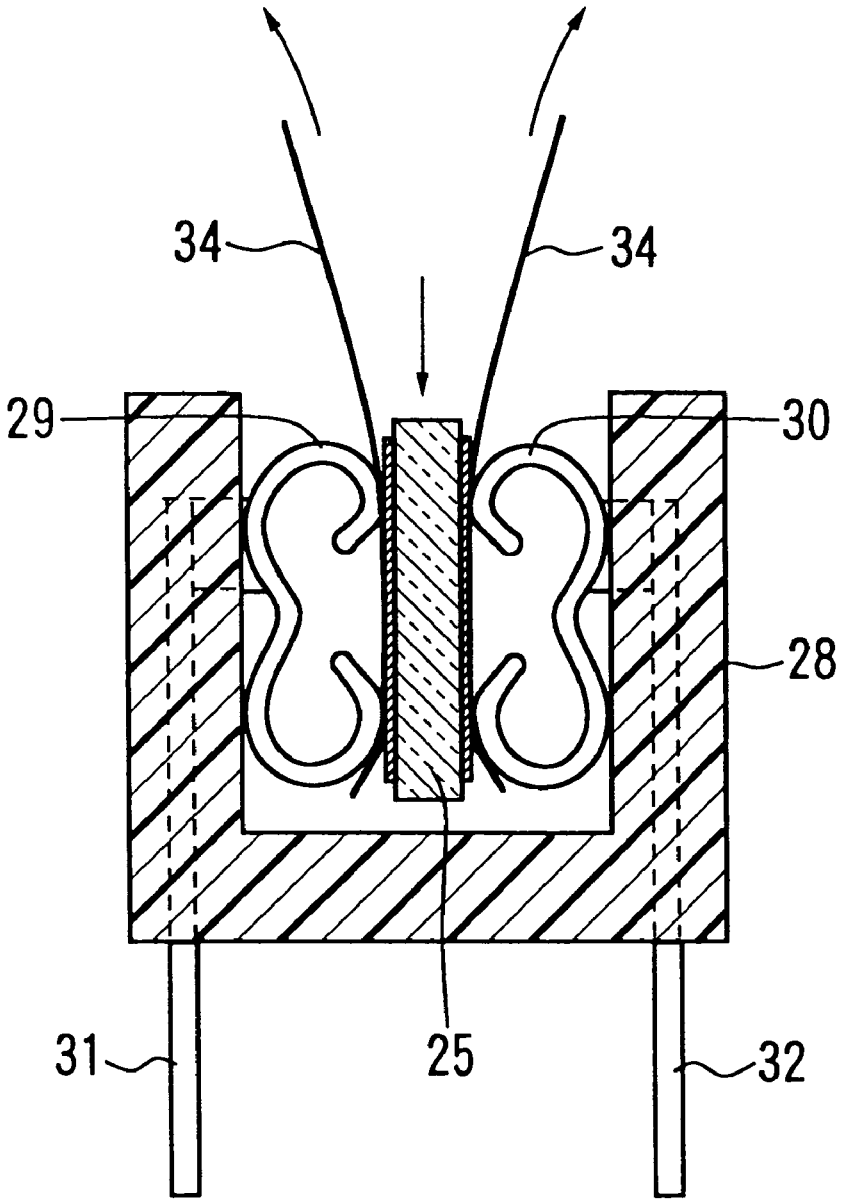
FIG. 20 Prior Art
FIG. 20 is another diagram further illustrating the mounting/assembly process of the PTC thermistor shown in FIGS. 17 and 18.
Figure 21:
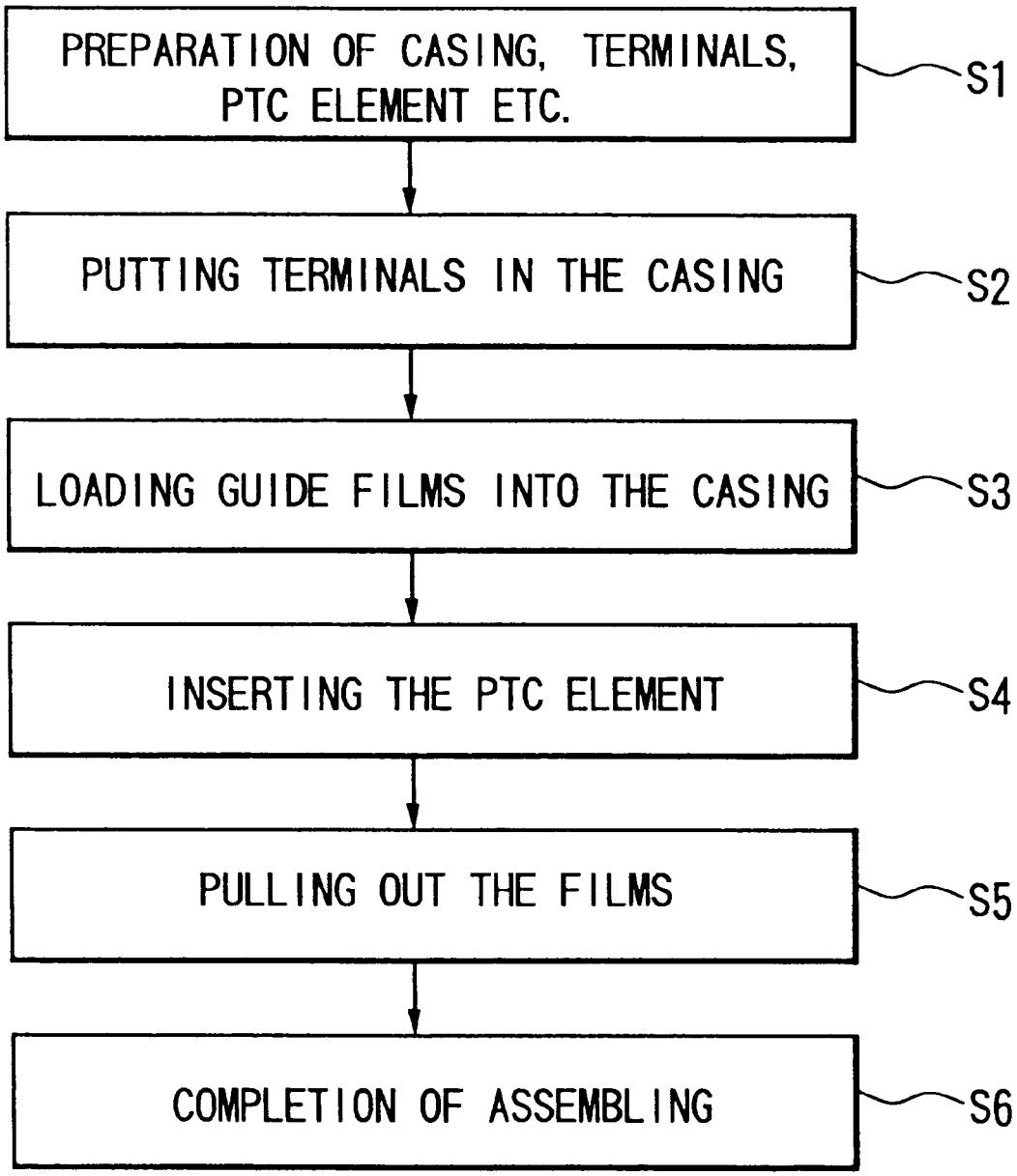
FIG. 21 Prior Art
FIG. 21 is a flowchart explaining the mounting/assembly process of the PTC thermistor shown in FIGS. 17 and 18.

FIG. 12 is a plan view showing yet another embodiment of a PTC thermistor device according to the present invention, FIG. 13 is a plan view showing a support member which is employed in the PTC thermistor device illustrated in FIG. 12, and FIG. 14 is a front view of the support member as looked at from a direction P of FIG. 13.

As shown, the PTC thermistor device is constituted of an insulating casing 40, first and second terminals 44 and 45 attached to the casing 40, PTC thermistor element 48 having electrodes on its both surfaces, and has a PTC thermistor element support structure for supporting the PTC thermistor element 48 5 by first terminal 44 and second terminal 45. In this case, the casing 40 is provided with the stainless-steel support member 61 for holding either one of the surfaces of PTC thermistor element 48. Note here that this support member 61 is electrically insulated from the first terminal 44 and the second terminal 45.

Further, the first terminal 44 is provided with a contact section 52 having conductivity and elasticity whereas the second terminal 45 is provided with a contact section 53 having conductivity and elasticity. The PTC thermistor element 48 is supported by a stainless-steel support member 61 on either one surface thereof while forcing the contact section 53 of second terminal 45 to become in contact with a PTC electrode portion spaced apart from the support member 61 on the same surface thereof and also letting the contact section 52 of the first terminal 44 to become in contact with a PTC electrode on the opposite surface of the PTC thermistor element 48.

In this case, the contact section 52 of first terminal 44 is designed to make contact with the PTC thermistor element electrode at a specifically selected position which is near the support member side and is approximately two third the distance between the support member 61 and the contact section 53 of second terminal 45. The stainless-steel support member 61 is formed by machining a plate of stainless steel (SUS304, for instance) in a way such that its distal end is bent causing a contact section 61a for contact with the PTC thermistor element 48 to be formed into a curved-face shape. This stainless-steel support member 61 is more excellent in heat resistivity than the insulating resin used in constituting the casing 40.

Furthermore, in a manner similar to that of the embodiment illustrated in FIGS. 7 to 11, the conductive sections 63 and 64 between the contact sections 52 and 53 which constitute the first terminal 44 and the second terminal 45 and the external terminal sections 50 and 51 are less in width than any remaining conductive parts of respective terminals increasing heat release resistivity.

As discussed above, the embodiment illustrated in FIGS. 12 to 14 employs the support member 61 made of stainless steel thus improving heat resistivity of the support member when compared to support members made of resin. This may in turn enable elimination of damages, scars and degradation of such support member otherwise occurring due to heat generation at the PTC thermistor element 48 while preventing the casing from becoming scarred. Accordingly, the PTC thermistor device can be lengthened in life span with reliability increased.

Although some preferred embodiments have been described above, the present invention may also be reduced to practice in several alternative ways which follow.

(1) While the terminal hook sections may be provided for both of the terminals, such hook sections may alternatively be provided only at either one of such terminals.

(2) While the first and second guide sections may be formed in such a way that these are integral with the casing (e. g. integral resin machining), the guide sections may alternatively be such that separately manufactured parts or components are later attached to the casing.

(3) The invention may also be practiced by putting a stainless steel cover on the insulating support member in lieu of the support member made of stainless steel.

It will be appreciated by those skilled in the art that the instant invention may be applicable for a wide variety of electronics devices or modules having package structures for use in, stably supporting therein a solid-state resistance-variable element with temperature coefficient of resistance including, but not limited to a PTC thermistor device adaptable for use as excess current or overcurrent protectors with motor driver circuitry in electric equipment including but not limited to electric refrigerators.

As has been described so far, the following advantages are obtained according to the present invention:

(a) It is possible to provide a PTC thermistor device which can avoid the problems faced with the prior art devices.

(b) It is possible to provide a PTC thermistor device which interrupts any possible overcurrent by accelerating spatial separation of fragments when a PTC thermistor element is destroyed due to thermal runaway.

(c) It is possible to provide a PTC thermistor device which can improve workability during mounting of the PTC thermistor element into an associated casing.

(d) It is possible to provide a PTC thermistor device which can eliminate occurrence of scars on electrode surfaces moreover enhancing stability of element position alignment.

We claim:

1. A PTC thermistor device comprising:

an insulating casing;

a PTC thermistor element comprising first and second electrodes;

first and second terminals attached to said insulating casing, said first and second terminals being conductive and elastic and having respectively a first contact section and a second contact section, said first and second contact sections being configured to contact said first and second electrodes, respectively; and first and second insulating guide sections protruding from said insulating casing, opposing each other and positioned so that said PTC thermistor element is between said first and second insulating guide sections and so that said PTC thermistor element is in contact with only one of said first and second insulating guide sections, said PTC thermistor element being held in position inside said insulating casing by only three contact points.

2. The PTC thermistor device according to claim 1, wherein said first contact section contacts said first electrode at a first end region of said PTC thermistor element, said second contact section contacts said second electrode at a center region of said PTC thermistor element, and said only one of said first and second insulating guide sections contacts said PTC thermistor element at a second end region of said PTC thermistor element.

3. The PTC thermistor device according to claim 1, wherein at least one of said first and second contact sections includes a hook section.

4. A PTC thermistor device comprising:

an insulating casing;

a PTC thermistor element comprising first and second electrodes;

first and second terminals attached to said insulating casing, wherein said first terminal is conductive and elastic and has a first contact region configured to contact said first electrode at a first contact point, and said second terminal is conductive but not elastic and has a second contact region configured to contact said second electrode at a second contact; and a support member protruding from said insulating casing and configured to contact said PTC thermistor element at a third contact point, said PTC thermistor element being held in position inside said insulating casing by only three contact points.

5. The PTC thermistor device according to claim 4, wherein said first contact point is located toward said third contact point at about two third of a distance between said second and third contact points.

6. A PTC thermistor device according to claim 4, wherein said support member comprises stainless steel.

7. A PTC thermistor device according to claim 4, wherein the width of a conductive section between each of the first and second contact sections of the first and second terminals and a respective associated external terminal section is less than widths of any remaining conductive sections of said first and second terminals.

8. A PTC thermistor device according to claim 5, wherein said support member comprises stainless steel.

9. A PTC thermistor device according to claim 5, wherein the width of a conductive section between each of the first and second contact sections of the first and second terminals and a respective associated external terminal section is less than widths of any remaining conductive sections of said first and second terminals.

10. A PTC thermistor device according to claim 6, wherein the width of a conductive section between each of the first and second contact sections of the first and second terminals and a respective associated external terminal section is less than widths of any remaining conductive sections of said first and second terminals.

* * * * *